US008361381B2

(12) United States Patent
Heuer et al.

(10) Patent No.: US 8,361,381 B2
(45) Date of Patent: Jan. 29, 2013

(54) MEDICAL IMPLANTS HAVING A POROUS COATED SURFACE

(75) Inventors: Daniel A. Heuer, Memphis, TN (US); Vivek Pawar, Germantown, TN (US); Marcus Lee Scott, Memphis, TN (US); Shilesh C. Jani, Germantown, TN (US)

(73) Assignee: Smith & Nephew, Inc., Memphis, TN (US)

( * ) Notice: Subject to any disclaimer, the term of this patent is extended or adjusted under 35 U.S.C. 154(b) by 774 days.

(21) Appl. No.: 12/506,737

(22) Filed: Jul. 21, 2009

(65) Prior Publication Data

US 2010/0074789 A1 Mar. 25, 2010

Related U.S. Application Data

(60) Provisional application No. 61/100,100, filed on Sep. 25, 2008.

(51) Int. Cl.
*B22F 7/04* (2006.01)

(52) U.S. Cl. ..... 419/8; 419/10; 419/19; 419/25; 419/26; 419/45; 419/49; 419/57

(58) Field of Classification Search ..... 148/281, 148/527, 672; 419/2, 8, 49; 427/2.24, 2.26, 427/2.27; 623/11.11–23.76
See application file for complete search history.

(56) References Cited

U.S. PATENT DOCUMENTS

| | | | |
|---|---|---|---|
| 2,987,352 | A | 6/1961 | Watson |
| 3,165,885 | A | 1/1965 | Tenney et al. |
| 3,287,111 | A | 11/1966 | Klepfer |
| 3,597,664 | A | 8/1971 | Villani |
| 3,615,885 | A | 10/1971 | Watson et al. |
| 3,715,265 | A | 2/1973 | Allen et al. |
| 4,145,764 | A | 3/1979 | Suzuki et al. |
| 4,160,680 | A | 7/1979 | Novy et al. |
| 4,238,251 | A | 12/1980 | Williams et al. |
| 4,272,855 | A | 6/1981 | Frey et al. |
| 4,381,716 | A | 5/1983 | Hastings et al. |
| 4,644,942 | A | 2/1987 | Sump |
| 4,662,288 | A | 5/1987 | Hastings et al. |
| 4,671,824 | A | 6/1987 | Haygarth |
| 4,673,409 | A | 6/1987 | Van Kampen |
| 4,746,532 | A | 5/1988 | Suzuki et al. |
| 4,747,915 | A | 5/1988 | Pagani |
| 4,860,757 | A | 8/1989 | Lynch et al. |
| 4,865,603 | A | 9/1989 | Noiles |
| 4,946,665 | A | 8/1990 | Recasens et al. |

(Continued)

FOREIGN PATENT DOCUMENTS

| | | |
|---|---|---|
| DE | 19815598 | 10/1999 |
| EP | 0410711 | 1/1991 |

(Continued)

OTHER PUBLICATIONS

Hobbs et al., "Oxidation Microstructures and Interfaces in the Oxidized Zirconium Knee", International Journal of Applied Ceramic Technology, 2005, 221-246, vol. 2 (3).

(Continued)

*Primary Examiner* — Roy King
*Assistant Examiner* — Christopher Kessler
(74) *Attorney, Agent, or Firm* — David A. Chambers; David A. Warmbold

(57) ABSTRACT

A process for making a diffusion hardened medical implant having a porous surface is disclosed. The medical implant is made by a hot isostatic pressing process which simultaneously forms that porous surface and the diffusion hardened surface.

25 Claims, 6 Drawing Sheets

U.S. PATENT DOCUMENTS 5,004,476 A 4/1991 Cook
5,017,830 A 5/1991 Koike
5,037,438 A 8/1991 Davidson
5,149,510 A 9/1992 Recasens et al.
5,152,794 A 10/1992 Davidson
5,169,597 A 12/1992 Davidson et al.
5,180,394 A 1/1993 Davidson
5,201,766 A * 4/1993 Georgette ..... 128/898
5,211,663 A 5/1993 Kovacs et al.
5,258,098 A 11/1993 Wagner et al.
5,265,137 A 11/1993 Busch
5,282,861 A 2/1994 Kaplan
5,316,594 A 5/1994 Kemp
5,338,771 A 8/1994 Neumann et al.
5,354,390 A 10/1994 Haszmann et al.
5,360,448 A 11/1994 Thramann
5,370,694 A 12/1994 Davidson
5,372,660 A 12/1994 Davidson et al.
5,383,934 A 1/1995 Armini et al.
5,399,207 A 3/1995 Kemp
5,405,394 A 4/1995 Davidson
5,415,704 A 5/1995 Davidson
5,456,723 A 10/1995 Steinemann et al.
5,496,359 A 3/1996 Davidson
5,505,984 A 4/1996 England et al.
5,507,815 A 4/1996 Wagner et al.
5,509,933 A 4/1996 Davidson et al.
5,549,700 A 8/1996 Graham et al.
5,562,730 A 10/1996 Davidson
5,571,017 A 11/1996 Niznick
5,571,139 A 11/1996 Jenkins
5,588,443 A 12/1996 Davidson
5,611,347 A 3/1997 Davidson
5,628,790 A 5/1997 Davidson et al.
5,632,779 A 5/1997 Davidson
5,647,858 A 7/1997 Davidson
5,649,951 A 7/1997 Davidson
5,688,453 A 11/1997 England et al.
5,716,400 A 2/1998 Davidson
5,782,910 A 7/1998 Davidson
5,830,396 A 11/1998 Higgins et al.
5,840,610 A 11/1998 Gilmer et al.
5,843,289 A 12/1998 Lee et al.
5,868,879 A 2/1999 Amick et al.
5,922,029 A 7/1999 Wagner et al.
5,933,167 A 8/1999 Shimada et al.
6,043,437 A 3/2000 Schulman et al.
6,059,830 A 5/2000 Lippincott et al.
6,063,442 A 5/2000 Cohen et al.
6,087,553 A 7/2000 Cohen et al.
6,146,686 A 11/2000 Leitao
6,193,762 B1 2/2001 Wagner et al.
6,207,218 B1 3/2001 Layrolle et al.
6,238,491 B1 5/2001 Davidson et al.
6,294,274 B1 9/2001 Kawazoe et al.
6,312,472 B1 11/2001 Hall et al.
6,395,327 B1 5/2002 Shetty
6,446,558 B1 9/2002 Peker et al.
6,447,550 B1 9/2002 Hunter et al.
6,472,122 B1 10/2002 Schulman et al.
6,554,793 B1 4/2003 Pauker et al.
6,585,772 B2 7/2003 Hunter et al.
6,599,322 B1 7/2003 Amrich et al.
6,652,586 B2 11/2003 Hunter et al.
6,682,611 B2 1/2004 Zhang et al.
6,726,725 B2 4/2004 Hunter et al.
6,771,490 B2 8/2004 Peker et al.
6,784,508 B2 8/2004 Tsunashima et al.
6,791,649 B1 9/2004 Nakamura et al.
6,818,078 B2 11/2004 Kim et al.
6,833,197 B1 * 12/2004 Dong et al. ..... 428/472.1
6,843,496 B2 1/2005 Peker et al.
6,869,701 B1 3/2005 Aita et al.
6,875,293 B2 4/2005 Peker
6,881,229 B2 4/2005 Khandkar et al.
6,887,586 B2 5/2005 Peker et al.
6,913,546 B2 7/2005 Kakuchi
6,921,702 B2 7/2005 Ahn et al.
6,945,448 B2 * 9/2005 Medlin et al. ..... 228/248.1
6,960,328 B2 11/2005 Bortun et al.
6,974,325 B2 12/2005 D'Zmura
6,974,625 B2 12/2005 Hunter et al.
7,008,490 B2 3/2006 Peker
7,017,645 B2 3/2006 Johnson et al.
7,029,558 B2 4/2006 Tomonaga et al.
7,048,767 B2 5/2006 Namavar
7,070,623 B2 7/2006 Hunter et al.
7,086,963 B1 8/2006 Onuki et al.
7,157,158 B2 1/2007 Collier et al.
7,235,129 B2 6/2007 Chen et al.
7,252,767 B2 8/2007 Bortun et al.
7,258,810 B2 8/2007 Hunter et al.
7,293,599 B2 11/2007 Peker et al.
7,306,994 B2 12/2007 Tsunashima et al.
7,368,023 B2 5/2008 Chang et al.
7,473,278 B2 1/2009 Hunter et al.
7,500,987 B2 3/2009 Bassler et al.
7,550,209 B2 6/2009 Pawar et al.
7,582,117 B2 9/2009 Hunter et al.
7,648,735 B2 1/2010 Hunter et al.
7,704,867 B2 4/2010 Kim et al.
7,896,926 B2 3/2011 Hunter et al.
7,923,067 B2 4/2011 Muramatsu et al.
7,968,209 B2 6/2011 Pawar et al.
2001/0019745 A1 9/2001 Beele et al.
2001/0023120 A1 9/2001 Tsunashima et al.
2002/0042656 A1 4/2002 Hunter et al.
2003/0033020 A1 2/2003 Hunter et al.
2003/0044301 A1 3/2003 Lefebvre et al.
2003/0125808 A1 7/2003 Hunter et al.
2003/0153979 A1 8/2003 Hughes et al.
2003/0153981 A1 8/2003 Wang et al.
2003/0202932 A1 10/2003 Elder et al.
2003/0207727 A1 11/2003 Kakiuchi
2003/0220699 A1 11/2003 Hunter et al.
2004/0002766 A1 1/2004 Hunter et al.
2004/0007532 A1 1/2004 Bortun et al.
2004/0023461 A1 2/2004 Ahn et al.
2004/0034432 A1 2/2004 Hughes et al.
2004/0122524 A1 6/2004 Hunter et al.
2004/0224182 A1 11/2004 Lazarev
2004/0232406 A1 11/2004 Weiss et al.
2005/0006675 A1 1/2005 Tsunashima et al.
2005/0009693 A1 1/2005 Woodhead
2005/0023603 A1 2/2005 Eldridge et al.
2005/0033442 A1 2/2005 Fisher et al.
2005/0079200 A1 4/2005 Rathenow et al.
2005/0083047 A1 4/2005 Lee et al.
2005/0129949 A1 6/2005 Hunter et al.
2005/0164045 A1 7/2005 Rothbrust et al.
2005/0184134 A1 8/2005 Charlebois et al.
2005/0287348 A1 12/2005 Faler et al.
2006/0020346 A1 1/2006 Hunter et al.
2006/0030663 A1 2/2006 Andre et al.
2006/0052880 A1 3/2006 Brosnahan et al.
2006/0058888 A1 3/2006 Hunter et al.
2006/0169364 A1 8/2006 Trotzschel et al.
2006/0259150 A1 11/2006 Hunter et al.
2007/0016163 A1 1/2007 Santini et al.
2007/0023388 A1 2/2007 Nair et al.
2007/0032877 A1 2/2007 Whiteside
2007/0137734 A1 * 6/2007 Pawar et al. ..... 148/206
2008/0038460 A1 2/2008 Muramatsu et al.
2008/0047931 A1 2/2008 Fesmire et al.
2008/0102616 A1 5/2008 Tsunashima et al.
2008/0156600 A1 7/2008 Eastham
2008/0196985 A1 8/2008 Meckel
2008/0281429 A1 11/2008 Pawar et al.
2009/0012611 A1 1/2009 Brosnahan et al.
2009/0074836 A1 3/2009 Pawar et al.
2009/0112331 A1 4/2009 Hunter et al.
2009/0305882 A1 12/2009 Dahar et al.
2010/0166548 A1 7/2010 Sayano et al.
2010/0174383 A1 7/2010 Pawar et al.
2011/0015756 A1 1/2011 Pawar et al.

FOREIGN PATENT DOCUMENTS

| | | |
|---|---|---|
| EP | 0555038 | 8/1993 |
| EP | 0 608 997 | 8/1994 |
| EP | 2077124 | 7/2009 |
| JP | 60-036654 | 2/1985 |
| JP | 07-173587 | 7/1995 |
| JP | 2001518827 | 10/2001 |
| JP | 2004089580 | 3/2004 |
| WO | WO-9402083 | 2/1994 |
| WO | WO-9616611 | 6/1996 |
| WO | WO-98/42390 | 10/1998 |
| WO | WO-99/04055 | 1/1999 |
| WO | WO-01/54565 | 8/2001 |
| WO | WO-03/008657 | 1/2003 |
| WO | WO-2005/037468 | 4/2005 |
| WO | WO-2008/154593 A1 | 12/2008 |

OTHER PUBLICATIONS

Long et al., "Nano-Hardness Measurements of Oxidized Zr-2.5Nb and Various Orthopaedic Materials", 24th Annual Meeting of the Society for Biomaterials, Apr. 22-26, 1998, San Diego, California, USA.

Sprague et al., "Mechanical Behavior of Zirconia, Alumina, and Oxidizen, Zirconium Modular Heads", ISTA, 2003, vol. 2.

Takamura, "Surface Hardening of Titanium by oxygen", Trans. JIM, 1962, 10-14, vol. 3.

Treco, "Solution and Diffusion of Corrosion Oxide Film in Zircaloy", J. Electrochem. Soc., 1962, 208-211, vol. 109.

N. Perkas et al., "Platinum and ruthenium catalysts on mesoporous titanium and zirconium oxides for the catalytic wet airr oxidation of model compounds", Applied Catalysis B: Environmental 59 (2005) pp. 121-130.

Campbell, F.C., Elements of Metallurgy and Engineering Alloys, "Recovery, Recrystallization, and Grain Groth", Chapter 8, 2008, pp. 117-127.

Horton, et al., "Biomedical potential of a Zirconium-Based Bulk Metallic Glass," found at http://www.oml.gov/webworks/cppr/y2001/pres/, Article No. 116372, 2003.

Study of Oxidation Behaviour of Zr-based Bulk Amorphous Alloy Zr65Cu17-5Ni10AI7-5 by thermogravimetric analyser; Bull. Mater. Sci., vol. 24, No. 3, Jun. 2001, pp. 281-283. O Indian Academy of Sciences.

Telford, "The case for bulk metallic glass", Materials Today, 7(3): 36-43, 2004.

Triwikantoro et al., "Oxidation of Zr-based Metallic Glasses in Air," Journal of Non-Crystalline Solids, 719-723, 1999.

Tuffias, "Novel Material Spinal Implants," BMDO Technologies for Biomedical Applications Chapter 3 Intervention Technologies Section A—Implants.

D.M. Brunette, P. Tengvall, M. Textor, and P. Thomsen, "Titanium in Medicine, Properties and Biological Significance of Naturl Oxide Films on Titanium and Its Alloys", (Springer, Berlin, Germany, 2001), pp. 172-174 and 177.

Cox, B., "A mechanism for the hydrogen uptake process in zirconium alloys", Journal of Materials, 264 (1999) pp. 283-294.

J.D. Ehrman et al., "Micrrobial adhesion to zirconium alloys", Colloids and Surfaces B: Biointerfaces, 50 (2006) pp. 152-159.

Easterday, C.L., Ashtabula, Ohio, "Zirconium Analysis by Production Control Quantometer" Analytical Chemistry (U.S.) Formerly Ind. Eng. Chem., Anal. Ed.; vol. 31, No. 11, pp. 1867-1868, Nov. 1, 1959.

D'Lima, Darryl D., M.D., et al., Bone Response to Implant Surface Morphology, The Journal of Arthroplasty, vol. 13, No. 8, pp. 928-934 (1998).

Wong, M., et al., Effect of surface topology on the osseointegration of implant materials in trabecular bone, Journal of Biomedical Materials Research, vol. 29, 1567-1575 (1995).

Dhawan et al., "Study of Oxidental Behaviour of Zr-based bulk amorphous ally Zr65Cul7-5Ni10A17-5 by thermogravimetric analyser," Bull. Mater. Sci., vol. 24(3): 281-283, Jun. 2001, Indian Academy of Sciences.

* cited by examiner

| | Ambient Pressure | | | | | Maximum $_{PP}O_2$ | | | | | Maximum Available Oxygen [mmo1/L] |
|---|---|---|---|---|---|---|---|---|---|---|---|
| | (psi) | (atm) | (Torr) | (bar) | (MPa) | (psi) | (atm) | (Torr) | (mbar) | (kPa) | |
| Ambient Air (Conventional Oxidation) | 14.7 | 1.0 | 14.7 | 14.7 | 14.7 | 3.1 | 0.210 | 160 | 212.8 | 21.28 | 2.8180 |
| < 0.0005% $0_2$ - Pressure Level 1 | 250.6 | 19.8 | 250.6 | 250.6 | 250.6 | 0.0015 | $9.9 \times 10^3$ | 0.076 | 0.1 | 0.001 | 0.0013 |
| < 0.0005% $0_2$ - Pressure Level 2 | 500 | 34.0 | 500 | 500 | 500 | 0.0025 | $1.7 \times 10^4$ | 0.13 | 0.172 | 0.017 | 0.0022 |
| < 0.0005% $0_2$ - Pressure Level 3 | 1000 | 1000 | 1000 | 1000 | 1000 | 0.0050 | $3.4 \times 10^4$ | 0.26 | 0.345 | 0.034 | 0.0044 |
| < 0.0005% $0_2$ - Pressure Level 4 | 1500 | 1500 | 1500 | 1500 | 1500 | 0.0075 | $4.1 \times 10^4$ | 0.39 | 0.517 | 0.052 | 0.0065 |
| < 0.0005% $0_2$ - Pressure Level 5 | 2000 | 2000 | 2000 | 2000 | 2000 | 0.0100 | $6.8 \times 10^4$ | 0.52 | 0.689 | 0.069 | 0.0087 |
| < 0.0005% $0_2$ - Pressure Level 6 | 2500 | 2500 | 2500 | 2500 | 2500 | 0.0125 | $8.5 \times 10^4$ | 0.65 | 0.862 | 0.086 | 0.0109 |
| < 0.0005% $0_2$ - Pressure Level 7 | 15000 | 15000 | 15000 | 15000 | 15000 | 0.0750 | $5.1 \times 10^3$ | 3.88 | 5.171 | 0.517 | 0.0653 |
| < 0.0005% $0_2$ - Pressure Level 8 | 30000 | 30000 | 30000 | 30000 | 30000 | 0.150 | 0.0102 | 7.76 | 10.342 | 1.034 | 0.131 |
| < 0.0005% $0_2$ - Pressure Level 9 | 60000 | 60000 | 60000 | 60000 | 60000 | 0.30 | 0.0204 | 15.52 | 20.684 | 2.068 | 0.261 |

*FIG. 9*

MEDICAL IMPLANTS HAVING A POROUS COATED SURFACE

CROSS-REFERENCE TO RELATED APPLICATIONS

This application claims priority to U.S. patent application Ser. No. 61/100,100, filed Sep. 25, 2008.

FIELD OF THE INVENTION

The present invention relates generally to prostheses and more particularly to implantable bone prostheses made of metal.

BACKGROUND OF THE INVENTION

Medical implant materials, in particular orthopedic implant materials, must combine high strength, corrosion resistance and tissue compatibility. The longevity of the implant is of prime importance especially if the recipient of the implant is relatively young because it is desirable that the implant function for the complete lifetime of a patient. Because certain metal alloys have the required mechanical strength, corrosion resistance, and biocompatibility, they are ideal candidates for the fabrication of prostheses. These alloys include 316L stainless steel, chrome-cobalt-molybdenum alloys (Co—Cr), titanium alloys, and more recently zirconium alloys, which have proven to be among the most suitable materials for the fabrication of load-bearing and non-load bearing prostheses.

To this end, oxidized zirconium orthopedic implants have been shown to reduce polyethylene wear significantly. The use of diffusion-hardened oxide surfaces such as oxidized zirconium in orthopedic applications was first demonstrated by Davidson in U.S. Pat. No. 5,037,438. Previous attempts have been made to produce oxidized zirconium coatings on zirconium parts for the purpose of increasing their abrasion resistance. One such process is disclosed in U.S. Pat. No. 3,615,885 to Watson which discloses a procedure for developing thick (up to 0.23 mm) oxide layers on Zircaloy 2 and Zircaloy 4. However, this procedure results in significant dimensional changes especially for parts having a thickness below about 5 mm, and the oxide film produced does not exhibit especially high abrasion resistance. U.S. Pat. No. 2,987,352 to Watson discloses a method of producing a blue-black oxide coating on zirconium alloy parts to increase abrasion resistance. Both U.S. Pat. No. 2,987,352 and U.S. Pat. No. 3,615,885 produce a zirconium oxide coating on zirconium alloy by means of air oxidation.

While medical implant devices made from biocompatible metal alloys are effective, they may lack certain desirable characteristics. For example, metal alloys have relatively poor flexibility and therefore do not tend to distribute load as evenly as would be desired. Uneven loads can result in a gradual loosening of the implant. As such loosening becomes more severe, revision or replacement becomes necessary. For this reason, it is desirable to design medical implants generally and prosthetic joints specifically in such a way as to maintain or improve their in vivo stability. In addition to the development of diffusion hardened surfaces to increase service life of medical implants by increasing their resistance to circumstances causing wear, there have been efforts to increase the useful life of medical implant by improving their fixation stability. In addition to wear, an implant may eventually fail if it loosens from the implantation site. Thus, advances in the area of fixation stability will address the other major source of implant failure and would represent a significant advance in implant service life. One way this problem has historically been addressed in the past is through the use of modified surfaces for medical implants which increase surface contact area and promote bone ingrowth and ongrowth. Another more recent technique involves the use of depositing material onto the surface of an implant, the material being the emission of a plasma spray source. This is discussed in U.S. Pat. Nos. 5,807,407 and 6,582,470, among others, which are incorporated by reference as though fully disclosed herein.

Medical implants are typically made from biocompatible metal alloys, such as titanium, zirconium, or cobalt chrome alloys. Not only are these metal alloys of sufficient strength to withstand relatively extreme loading conditions but due to their metallic nature, a metallic porous coating (one example being the alloy Ti-6Al-4V) may be secured to the substrate metal alloy by a metallic bond. Such metallic porous coatings are useful for providing initial fixation of the implant immediately after surgery but also serve to facilitate long-term stability by enhancing bone ingrowth and ongrowth. It is important, however, that the process of making the porous surface does not compromise the other properties of the medical implant. If fabrication of the porous surface requires harsh conditions such as high temperatures, the microstructure of the material comprising the implant may be compromised.

One such method that is able to form a porous surface and preserve the implant material microstructure is a modification of what is known as the hot isostatic pressing process (the "HIP process"). Hot isostatic pressing is a manufacturing process normally used to increase the density of metal and ceramic materials, often resulting in improved strength or workability. The HIP process subjects a component to both elevated temperature and isostatic gas pressure in a high pressure containment vessel. An inert gas is typically used so that the component material does not react with the gas. A commonly used inert pressurizing gas is argon, although others are used as well. Examples of other inert gas include helium, xenon, and others The chamber is heated, causing the pressure inside the vessel to increase. Many systems use associated gas pumping to achieve necessary pressure level. The pressurizing gas applies pressure to the component uniformly from all directions (hence the term "isostatic"). For processing castings, the inert gas is applied between 7,350 psi. (51 MPa) and 45,000 psi. (310 MPa). 15,000 psi is a commonly used pressure. Process soak temperatures range from 900° F. (480° C.) for aluminum castings to 2400° F. (1315° C.) for nickel based superalloys. When castings are HIP-treated, the simultaneous application of heat and pressure eliminates internal voids and microporosity through a combination of plastic deformation, creep, and diffusion bonding. Primary applications are the reduction of microshrinkage, the consolidation of powder metals, ceramic composites, and metal cladding. HIP processing is also used as part of a sintering (powder metallurgy) process and for fabrication of metal matrix composites.

The HIP process also provides a method for producing components from diverse powdered materials, including metals and ceramics. During such manufacturing processes, a powder mixture of several elements is placed in a container, typically a steel can. The container is subjected to elevated temperature and a very high vacuum to remove air and moisture from the powder. The container is then sealed, and the HIP process is applied to the sealed container. The application of high inert gas pressures and elevated temperatures results in consolidation of the powder and the removal of internal voids. The result is a clean homogeneous material with a uniformly fine grain size and a near 100% density. HIP processing eliminates internal voids and creates clean, firm bonds and fine, uniform microstructures. These characteristics are not possible with welding or casting. The virtual elimination of internal voids enhances part performance and improves fatigue strength. The process also results in significantly improved non-destructive examination ratings.

In U.S. Pat. No. 5,201,766 to Georgette, a HIP process is used to form a porous matrix and a porous matrix having a uniform surface, depth and a controlled microstructure is provided. The '766 patent teaches the use of a HIP process to form a prosthetic device having a porous coating formed of the titanium alloy Ti-6Al-4V.

There remains a need to combine the unparalleled wear properties of diffusion hardened ceramic oxide surfaces with a metallic porous surfaces to enhance fixation stability while not compromising the microstructure of the material of the implant. The present invention provides one solution to that end.

All of the above-referenced U.S. patents and published U.S. patent applications are incorporated by reference as though fully described herein.

SUMMARY OF THE INVENTION

According to one embodiment of the invention, there is provided a method of making a medical implant having a porous surface and a blue, blue-black, or black oxidized zirconium, the method comprising the steps of forming a medical implant from a zirconium or zirconium alloy material; applying a HIP sintering material to at least one surface of the implant; attaching an enclosure around a surface of the implant such that the attached enclosure contains the HIP sintering material, the enclosure having an inner surface which is proximal to the implant surface and an outer surface which is distal to the implant surface and wherein the enclosure is formed of a collapsible material; evacuating substantially all air from the enclosure; sealing the evacuated enclosure; placing the implant, the HIP sintering material, and the enclosure in a HIP furnace; pressurizing the inside of the HIP furnace to an elevated pressure in an atmosphere comprising an inert gas and oxygen, the step of pressuring comprising pressuring to a total pressure of from about 20 to about 4000 bar and a partial pressure of oxygen of from about 0.1 to about 21 mbar; adjusting the temperature in the furnace to a temperature of from 500° C. to 1000° C.; and, causing the implant, the HIP sintering material, and the enclosure in the HIP furnace to remain exposed to the temperatures and pressures for a time sufficient to fuse the HIP sintering material together and to the surface of the implant; and oxidize at least a portion of the surface of the implant to blue blue-black or black oxidized zirconium, the time ranging from about 30 minutes to about 10 hours; and thereafter, cooling the implant, the metallic beads and/or particles, and the enclosure; and, removing the enclosure.

In some embodiments, the step of attaching an enclosure comprises attaching an enclosure having an inner surface comprising molybdenum.

In some embodiments, the step of attaching an enclosure comprises attaching an enclosure having an inner surface comprising hydroxyapatite.

In some embodiments, the inert gas comprises argon.

In some embodiments, the HIP sintering material is comprised of beads and/or particles of a US Sieve Series mesh size between 18 and 80.

In some embodiments, the step of adjusting the temperature in the furnace, comprises adjusting said temperature to a temperature below the temperature at which the material forming the implant, the HIP sintering material, or both the implant and HIP sintering material undergoes a change in microstructure.

In some embodiments, the step of applying comprises applying with HIP sintering material comprising zirconium or zirconium alloy.

In some embodiments, the zirconium alloy is Zr-2.5Nb.

In some embodiments, the step of applying comprises applying with HIP sintering material comprising titanium or titanium alloy.

In some embodiments, the titanium alloy is Ti-6Al-4V.

In some embodiments, the step of adjusting the temperature in said furnace, comprises adjusting said temperature to a temperature of 680° C.

In some embodiments, the step of pressurizing comprises pressurizing with a gas comprising oxygen at a level ranging from 0.05% to 0.00005%.

In some embodiments, the oxygen in said gas is at a level of 0.0005%.

In some embodiments, the time of exposure to fuse the HIP sintering material together and to the surface of the implant is about 4 hours.

In some embodiments, the method further comprises the step of masking a portion of the surface of the zirconium or zirconium alloy medical implant prior to the step of placing the implant, the HIP sintering material, and the enclosure in a HIP furnace.

In some embodiments, the step of applying a HIP sintering material comprises applying a HIP sintering material and a binder to the at least one surface, the step of attaching an enclosure comprises attaching an enclosure comprising a vent, and the method further comprises the step of vacuum treating the HIP sintering material, the binder, and the implant surface.

In another embodiment of the invention, there is a method of making a medical implant having a blue blue-black or black oxidized zirconium, the method comprising the steps of forming a medical implant from a zirconium or zirconium alloy material; placing the implant in a HIP furnace; pressurizing the inside of the HIP furnace to an elevated pressure in an atmosphere comprising an inert gas and oxygen, the step of pressuring comprising pressuring to a total pressure of from about 20 to about 4000 bar and a partial pressure of oxygen of from about 0.1 to about 21 mbar; adjusting the temperature in the furnace to a temperature of from 500° C. to 1000° C.; and, causing the implant to remain exposed to the temperatures and pressures for a time sufficient to oxidize at least a portion of the surface of the implant to blue blue-black or black oxidized zirconium, the time ranging from about 30 minutes to about 10 hours.

In some embodiments, the inert gas comprises argon.

In some embodiments, the step of adjusting the temperature in the furnace, comprises adjusting the temperature to a temperature below the temperature at which the material forming the implant undergoes a change in microstructure.

In some embodiments, the step of forming a medical implant from a zirconium or zirconium alloy material comprises forming said medical implant from Zr-2.5Nb alloy.

In some embodiments, the step of adjusting the temperature in said furnace, comprises adjusting said temperature to a temperature of 680° C.

In some embodiments, the step of pressurizing comprises pressurizing with a gas comprising oxygen at a level ranging from 0.05% to 0.00005%.

In some embodiments, the oxygen in said gas is at a level of 0.0005%.

In some embodiments, the time of exposure to fuse the HIP sintering material together and to the surface of the implant is about 4 hours.

In some embodiments, the method further comprises the step of masking a portion of the surface of the zirconium or zirconium alloy medical implant prior to said step of placing said implant in a HIP furnace.

Further areas of applicability of the present invention will become apparent from the detailed description provided hereinafter. It should be understood that the detailed description and specific examples, while indicating certain embodiment of the invention, are intended for purposes of illustration only and are not intended to limit the scope of the invention.

BRIEF DESCRIPTION OF THE DRAWINGS

The accompanying drawings, which are incorporated in and form a part of the specification, illustrate the embodiments of the present invention and together with the written description serve to explain the principles, characteristics, and features of the invention. In the drawings:

FIG. 9 is a table of data for simultaneous HIP sintering and diffusion hardening/oxidation of Zr-2.5Nb.

DETAILED DESCRIPTION OF THE INVENTION

Figure 1:
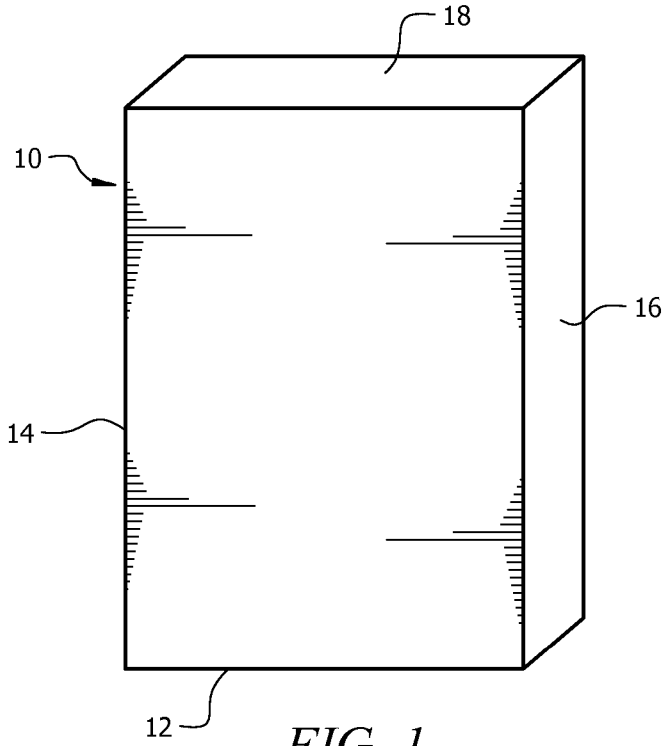
FIG. 1 is a front view of a medical implant.

The following description of the preferred embodiment(s) is merely exemplary in nature and is in no way intended to limit the invention, its application, or uses.

As used herein, "a" and "an" include both the singular and the plural and mean one or more than one.

The invention provides, in part, orthopedic implants having oxidized zirconium surfaces or prostheses fabricated of zirconium or zirconium containing metal alloys or a thin coating of zirconium or zirconium alloy on conventional orthopedic implant materials. The oxidized zirconium herein described throughout is the blue-black or black oxidized zirconium described by Davidson in U.S. Pat. No. 5,037,438 and by Watson in U.S. Pat. No. 2,987,352, both of which are incorporated by reference as though fully described herein. In order to form continuous and useful oxidized zirconium coatings over the desired surface of the metal alloy prosthesis substrate, the metal alloy preferably contain from about 80 to about 100 wt % zirconium, most preferably from about 95 to about 100 wt %. Oxygen, niobium, and titanium include common alloying elements in the alloy with often times the presence of hafnium. Yttrium may also be alloyed with the zirconium to enhance the formation of a tougher, yttria-stabilized oxidized zirconium coating during the oxidation of the alloy. While such zirconium containing alloys may be custom formulated by conventional methods known in the art of metallurgy, a number of suitable alloys are commercially available. These commercial alloys include, among others, Zircadyne 705, Zircadyne 702, and Zircalloy.

The base zirconium containing metal alloys are cast, worked, or machined by conventional methods to the shape and size desired to obtain a substrate. The substrate is then subjected to process conditions which cause the natural (in situ) formation of a tightly adhered coating of oxidized zirconium on its surface. The process conditions include, for instance, air, steam, or water oxidation or oxidation in a salt bath. These processes ideally provide a thin, hard, dense, blue-black or black, low-friction wear-resistant oxidized zirconium film or coating of thicknesses typically on the order of several microns ($1\times10^{-6}$ meters) on the surface of the substrate. Below this coating, diffused oxygen from the oxidation process increases the hardness and strength of the underlying substrate metal.

The air, steam and water oxidation processes and the oxidized zirconium surfaces (blue-black or black oxidized zirconium) produced therefrom are described in U.S. Pat. No. 2,987,352 to Watson and in U.S. Pat. No. 5,037,438 to Davidson, the teachings of which are incorporated by reference as though fully set forth. The air oxidation process provides a firmly adherent black or blue-black layer of oxidized zirconium of highly oriented monoclinic crystalline form. If the oxidation process is continued to excess, the coating will whiten and separate from the metal substrate. The oxidation step may be conducted in air, steam or hot water. For convenience, the metal substrate may be placed in a furnace having an oxygen-containing atmosphere (such as air) and typically heated at 700° F. to 1100° F. for up to about 6 hours. However, other combinations of temperature and time are possible. When higher temperatures are employed, the oxidation time may be reduced to avoid the formation of the white oxide.

It is preferred that a blue-black oxidized zirconium layer ranging in thickness from about 1 to about 20 microns is obtained. Most preferably, the thickness is from about 1 to 5 microns. For example, furnace air oxidation at 1000° F. for 3 hours forms an oxide coating on Zircadyne 705 about 4-5 microns thick. Longer oxidation times and higher oxidation temperatures increases this thickness but may compromise coating integrity. For example, one hour at 1300° F. forms an oxide coating of about 14 microns in thickness, while 21 hours at 1000° F. forms an oxide coating thickness of about 9 microns. Of course, because only a thin oxide is necessary on the surface, only very small dimensional changes, typically less than 10 microns over the thickness of the implant, results. In general, thinner coatings (1-4 microns) have better attachment strength.

One of the salt-bath methods that may be used to apply the oxidized zirconium coatings to the metal alloy implant, is the method of U.S. Pat. No. 4,671,824 to Haygarth, the teachings of which are incorporated by reference as though fully set forth. The salt-bath method provides a similar, slightly more abrasion resistant blue-black or black oxidized zirconium coating. The method requires the presence of an oxidation compound capable of oxidizing zirconium in a molten salt bath. The molten salts include chlorides, nitrates, cyanides, and the like. The oxidation compound, sodium carbonate, is present in small quantities, up to about 5 wt. percent. The addition of sodium carbonate lowers the melting point of the salt. As in air oxidation, the rate of oxidation is proportional to the temperature of the molten salt bath and the '824 patent prefers the range 550° C. to 800° C. (1022° F. to 1470° F.). However, the lower oxygen levels in the bath produce thinner coatings than for furnace air oxidation at the same time and temperature. A salt bath treatment at 1290° F. for four hours produces an oxide coating thickness of roughly 7 microns.

Whether air oxidation in a furnace or salt bath oxidation is used, the oxidized zirconium coatings are quite similar in hardness. For example, if the surface of a wrought Zircadyne 705 (Zr, 2-3 wt percent Nb) prosthesis substrate is oxidized, the hardness of the surface shows a dramatic increase over the 200 Knoop hardness of the original metal surface. The surface hardness of the blue-black oxidized zirconium surface following oxidation by either the salt bath or air oxidation process is approximately 1700-2000 Knoop hardness.

In addition to the oxidized zirconium compositions of Davidson and Watson, a new oxidized zirconium composition has recently been disclosed. The new composition, disclosed in U.S. Patent Publication U.S. 2007/0137734 A1 and PCT Application PCT/US2006/043838 (published as PCT Publication No. WO/2007/078427), of Pawar et. al. is a composition having unique diffusion zone thickness and hardness profile not seen in earlier compositions.

These diffusion-hardened, low friction, highly wear-resistant oxidized zirconium coatings are applied to the surfaces of orthopedic implants subject to conditions of wear. Such surfaces include the articulating surfaces of knee joints, elbows and hip joints. As mentioned before, in the case of hip joints, the femoral head and stem are typically fabricated of metal alloys while the acetabular cup may be fabricated from ceramics, metals or organic polymer-lined metals or ceramics.

The usefulness of oxidized zirconium prosthesis having oxidized zirconium surfaces is not limited to load bearing prostheses, especially joints, where a high rate of wear may be encountered. Because the oxidized zirconium surface is firmly bonded to the zirconium alloy prosthesis substrate, it provides a barrier between the body fluids and the zirconium alloy metal thereby preventing the corrosion of the alloy by the process of ionization and its associated metal ion release.

Oxygen diffusion from the oxidized surface into the metal substrate during oxidation also increases the strength of the metal. Consequently, a prosthesis having an oxidized zirconium surface may be expected to have a greater useful service life with respect to the effects of wear. However, the other major factor affecting the useful life of medical implants is the fixation stability of the implant. For example, implants such as knee and hip implant and anchored into the bone stock of the patient. Over time the means of fixation can begin to fail, resulting in the need to replace or revise the implant. Some efforts to address the issue of fixation stability include the use of porous surfaces on the implants to increase the effective surface area of the implant and to promote bone ingrowth into the porous structure.

U.S. Pat. No. 5,201,766 teaches the use of a HIP process on beads or particles placed in physical contact with a medical implant. The result is a fusion of the beads or particles at their points of contact without the full consolidation typically desired from a HIP process, thereby resulting in a porous surface. Furthermore, because the conditions of the HIP process are relatively mild (namely a lower temperature is used), the microstructure of the implant is not adversely affected.

Non-limiting examples for the starting material for use in a HIP process can be spherical beads, asymmetric particles, pre-formed porous metallic pads, etc. Other possibilities known to those of skill in the art can also be used. Pre-formed porous metallic pads can be made by any technique known in the art. One such technique is a scaffold method in which an open-celled, reticulated scaffold is coated with a metallic material by a process such as vapor deposition. Another such technique is a sacrificial scaffold method, in which an open-celled, reticulated sacrificial scaffold is coated with a metallic slurry or metallic particles, and the coated structure is then sintered to fuse the metallic coating and decompose the sacrificial scaffold. Another such technique involves sintering together a thin pad consisting of multiple layer of spherical or asymmetric metallic particles. This technique may or may not include a dispersion of sacrificial material among the particles which would decompose during the sintering step to produce additional porosity.

In a typical process of the present invention for forming a porous surface on a medical implant using a HIP process, the material that will form the porous surface (also referred to herein as the "HIP sintering material") is applied to the surface to be porous-coated. Typically, it is introduced through a cavity or otherwise and onto the surface of the medical implant or onto the material which will form the medical implant. While the step of applying typically comprises depositing the material onto the surface of interest any means of application is possible. A collapsible, foil-like metal material having flanges (or similar components which can form a union) is connected to the implant, thereby forming an enclosure over the HIP sintering material. The collapsible, material forming the enclosure is alternatively referred to herein as the "can", or "container", or "shroud" or "enclosure." The flanges can be connected by any suitable means for forming an airtight seal such as welding, soldering or the like. The collapsible, metallic foil-like material having the flanges forms a can or container around the HIP sintering material. In the case of an implant formed of zirconium or zirconium alloy, the can or container is preferably formed of zirconium or zirconium alloy. In some embodiments, the surface of the can or container facing the HIP sintering material is composed of molybdenum or other suitable material to prevent the bonding of the beads or particles to the can or container. The can or container is preferably welded to the medical implant or material which will form the medical implant around the periphery of the enclosure. The HIP sintering material is introduced in the cavity or onto the surface prior to the can or container being completely sealed to the medical implant. In one embodiment, the can or container is first sealed to the medical implant around a portion of its periphery forming an enclosure with at least one opening, and the HIP sintering material is then charged into the enclosure through the at least one opening. The at least one opening is preferably in at least one corner or edge of the enclosure so that the enclosure may be completely filled with the HIP sintering material (with the assistance of gravity). The spherical beads or particles are preferably of a uniform size would pack with low density and result in a porous matrix that promotes ingrowth of bone tissue. It is within the ability of one with ordinary skill in the art to select an appropriate bead or particle size range to form a porous matrix with the desired pore size.

The can or container is preferably of a size and shape and the process parameters are such that the finished porous surface is 0.5 to 5.0 mm thick, although other thicknesses could be utilized.

Prior to completely sealing the can or container to the medical implant, the enclosure is evacuated by suitable vacuum means (not shown) and the can or container is sealed completely around the periphery of the enclosure by suitable means such as welding, soldering or the like such that a vacuum is maintained within the can or container. The prosthesis is then subjected to a hot isostatic pressing process (HIP process), which provides for uniform, low-density fusion of the HIP sintering material within the can or container to one another and to the substrate at a temperature that does not adversely effect the microstructure of the substrate.

The HIP process is carried out in an oven that includes an airlock. The implant is prepared as described and placed within the oven, which is then evacuated and charged with an argon atmosphere. The oven is heated to the desired temperature while the atmosphere therein is pressurized to the desired pressure. The HIP process applies an isostatic pressure through an inert gas such as argon. By applying sufficient pressure during the heating step, the HIP sintering material is fused together and to the implant surface at a temperature below that which transforms the microstructure of the implant material to a weakened state.

The HIP process can apply pressure up to about 60,000 psi (about 4200 bar) at temperatures from about 27° C. to 1370° C. For a typical titanium alloy implants with titanium alloy HIP sintering material for the porous surface, a temperature of about 900° C. and a pressure of about 300 psi-500 psi are preferable. For zirconium or zirconium alloy-based implants, similar ranges for temperature and pressure are useful. The preferred inert gas for use in such an HIP process is argon. The duration of the HIP process can range from about 30 minutes to about 10 hours with a preferred time for a zirconium alloy matrix of about 3-6 hours depending on configuration and size of the porous matrix to be formed.

After the prosthesis has been subjected to the elevated pressure and temperature sufficient to fuse the HIP sintering material together and to the remaining portion of the implant, the implant is cooled gradually by removing heat from the furnace after pressure has been relieved. The slow furnace cooling controls the formation of stress between the porous matrix and the substrate so that a high-strength durable bond is formed. Also, through the application of heat and pressure in the HIP furnace, the HIP sintering material is compacted such that it is flush with the outer boundaries of the cavity or otherwise completely cover the intended surface This forms a good porous surface and a visually pleasing and finished porous implant product. The particle size, pressure and temperature can be manipulated based on the materials used, the nature of the implant (size, geometry, etc.), and other considerations familiar to those of skill in the art to optimize results.

After the implant and porous matrix have been cooled to room temperature, the container or can and flanges are cut away from the implant and the edges are preferably machined to provide a smooth outer surface. An outer portion of the flange can be machined to be flush with the outer surface of the HIP sintering material. The porous matrix is left with a uniform surface and depth completely filling the cavity or covering the surface.

Because HIP processing uses an inert gas atmosphere, it was originally believed that to make implants comprising porous surfaces and diffusion hardened oxidized zirconium surfaces, a step-wise HIP process-based sintering, followed by a diffusion-hardening oxidation process would be necessary. Such a process would utilize a container or can as described above to HIP sinter the material, resulting in a porous surface. The container or can is then left on the newly created porous structure in order to protect it from subsequent processing which creates the diffusion-hardened oxidized zirconium surface. However, the inventors have found that, instead of using an inert gas as is done in conventional HIP sintering applications, by using a gas comprising an inert gas with a low level of oxygen at elevated pressures, it is possible to create a diffusion-hardened oxidized zirconium surface on a zirconium or zirconium alloy substrate. Furthermore, such conditions can be applied to a zirconium or zirconium alloy substrate both in the absence of and in the presence of, any HIP sintering material.

When done in the absence of any HIP sintering material, it provides a new method to form oxidized zirconium compositions. When done in the presence of a HIP sintering material, it provides a method to simultaneously form an oxidized zirconium surface and create a porous surface. It also provides a composition comprising an oxidized zirconium surface and a porous surface, while preserving or substantially preserving the original microstructure of the substrate, owing to the conditions of the HIP process.

One advantage of forming a diffusion hardened oxidized zirconium surface using HIP conditions with low levels of oxygen is that it is much easier, when compared to conventional methods of forming such surfaces, to mask areas in which oxidation is not required or desired. Under the conditions of the present invention, the surfaces of the zirconium or zirconium alloy that are in close proximity or contact with a supporting surface do not oxidize. That is a significant attribute of this new method which is unlike traditional air oxidation methods in which it is difficult to prevent oxidation of any zirconium surfaces. Thus, it is quite easy to mask surfaces in which oxidation is not required or desired. In one embodiment, prior to the HIP process, a metal foil is applied onto the zirconium surfaces for which oxidation is not desired. This foil, being in close proximity or contact with the zirconium surfaces, is suitable to prevent oxidation of the underlying substrate. In another embodiment, prior to the HIP process, the zirconium component is placed on a fixture that mates with at least a portion of the zirconium component over the region for which oxidation is not desired. This fixture, being in close proximity or contact with the zirconium surfaces, is suitable to prevent oxidation of the adjacent substrate.

FIG. 1 illustrates a medical implant 10 having a first bearing surface 12, a second bearing surface 14, and a third bearing surface 16. The medical implant 10 also includes a bone-facing surface 18. The implant 10 may be made from zirconium or zirconium containing metal alloys or a thin coating of zirconium or zirconium alloy on conventional orthopedic implant substrate materials.

Figure 2:
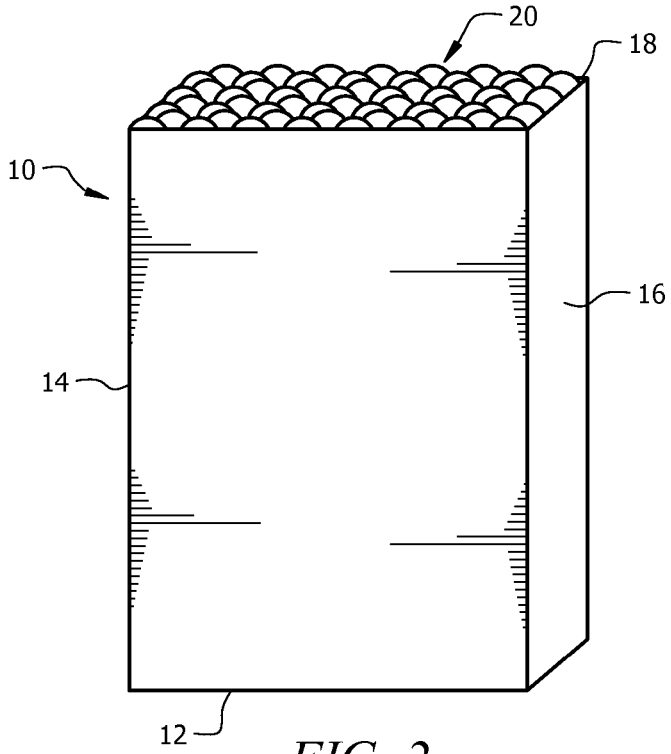
FIG. 2 is a front view of the medical implant with a porous metal coating.

FIG. 2 illustrates the medical implant 10 as in FIG. 1 having HIP sintering material coating 20 applied to the bone facing surface 18. The coating 20 may take the form of fused beads and/or particles and/or wire mesh, and/or a thin sheet of porous metal as described above. Zirconium or zirconium alloy (one example being Zr-2.5Nb) can be used to provide the HIP sintering material to which surrounding bone or other tissue may integrate to stabilize the prosthesis. Alternatively, the porous coating 20 may be made of titanium or titanium alloy, such as Ti-6Al-4V. These materials for the porous coatings are HIP processed to form the porous coating and can be simultaneously oxidized to blue-black or black oxidized zirconium (in the case of zirconium or zirconium alloy) under HIP processing conditions. Furthermore, zirconium or zirconium alloy can also be used as a surface layer applied over conventional implant materials prior to in situ HIP fusing and oxidation.

Figure 3:
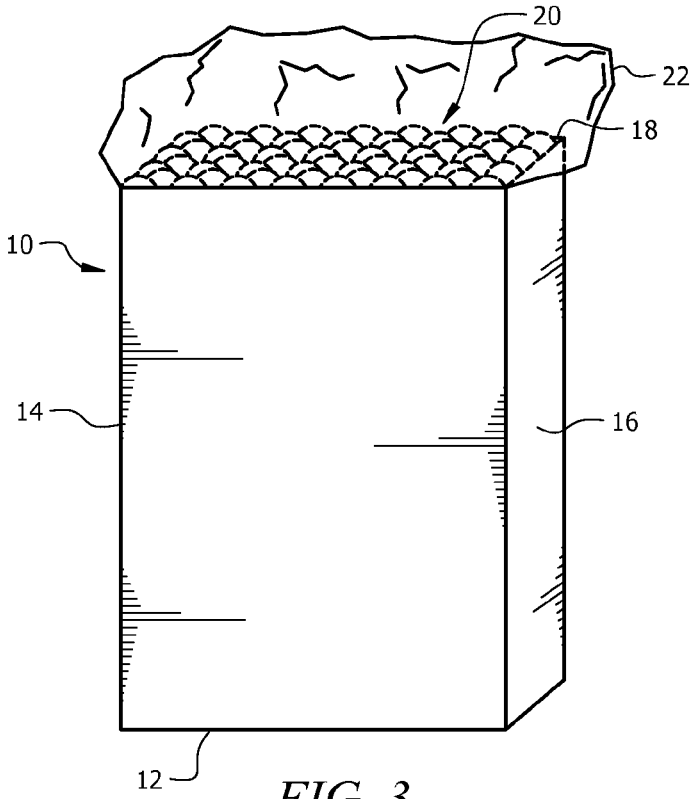
FIG. 3 is a front view of the medical implant with a shroud.

After the porous coating is applied to the substrate, it may be desirable to oxidize all or a portion of the implant. However, to prevent oxidization of the porous coating 20, the porous coating 20 may be covered with a protective coating or covering. FIG. 3 illustrates the medical implant 10 having a shroud 22. In the embodiment depicted in FIG. 3, the shroud 22 is made of molybdenum but other materials may be used.

Figure 4A:
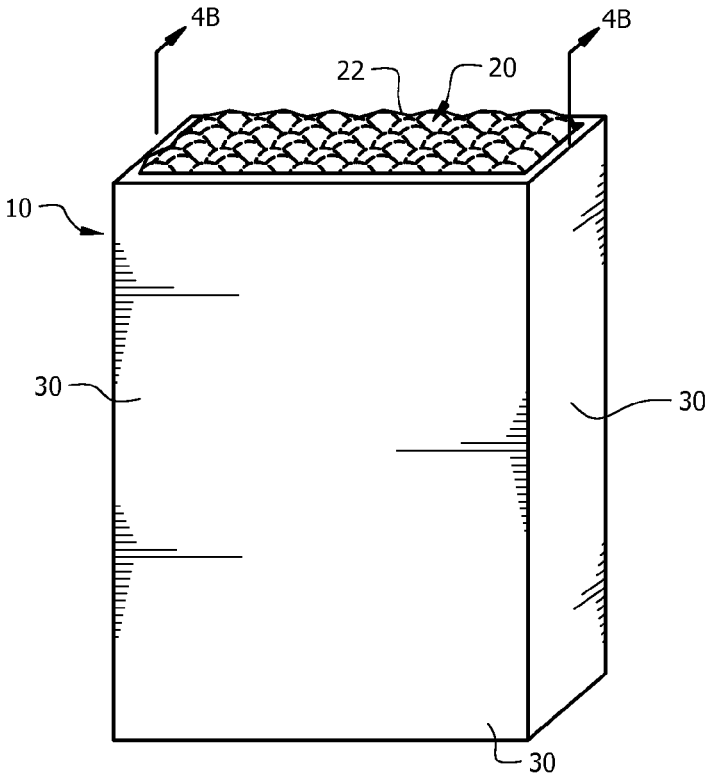
FIG. 4A is a front view of the medical implant with an oxidation layer on one or more surfaces.
Figure 4B:
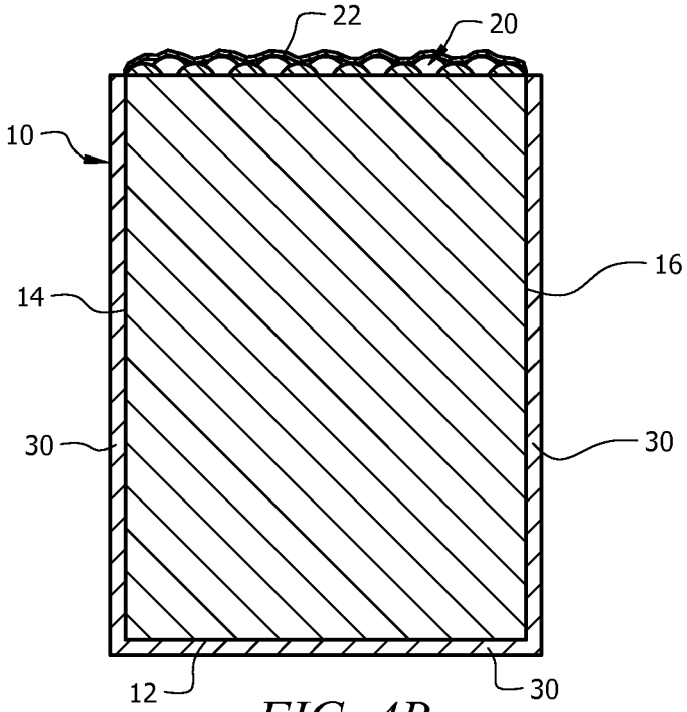
FIG. 4B is a cross-sectional view of the medical implant of FIG. 4A.

FIGS. 4A and 4B illustrate medical implant 10 after it has been subjected to a hot isostatic press (HIP) to bond the porous coating 20 and to at least partially oxidize the bearing surfaces 12, 14, 16. U.S. Pat. No. 4,603,801, herein incorporated by reference, discloses a method of using the HIP process to diffusion bond two materials. The typical atmosphere and pressure of the HIP process is utilized for a time sufficient to achieve: (1) well-adhered oxide layer 30 on the bearing surfaces 12, 14, 16; (2) fatigue strength sufficient for application in orthopaedic components and particularly knee femoral components; (3) sufficient attachment strength of the porous coating 20 to the substrate; and (4) sufficient attachment strength both within the porous coating and between the coating and the substrate. In some embodiments, one or more of surfaces 12, 14, and 16 are partially oxidized before bonding of the porous coating 20. FIG. 4B is a cross-sectional view of the medical implant 10 of FIG. 4A. It should be noted that all surfaces not covered by shroud 22 and not otherwise shielded from the HIP process atmosphere will develop an oxide layer 30 to some extent.

Alternatively, if the HIP sintering material coating 20 is not applied in the schematic of FIG. 2 and the shroud 22 of FIG. 3 is not used, and the HIP conditions are applied, the result is a diffusion hardened oxidized zirconium surface. Again, formation of the diffusion hardened oxidized zirconium surface is achieved if the HIP process applied comprises the use of a gas comprising an inert gas with a low level of oxygen and elevated pressures, which is unlike conventional HIP processes which use an inert gas as the pressure medium.

The hot isostatic pressing process involves the simultaneous application of pressure and temperature to a workpiece. In essence, the workpiece is squeezed from all sides at elevated temperatures. Generally, a pressure, up to approximately 60,000 psi (approximately 4200 bar), is applied by a pressure or energy transmitting medium; i.e. gas or molten inert glass powder or beads. The applied pressure, along with the temperature increase, causes diffusive bonding of the cladding to the substrate. Diffusive bonding is accomplished by holding the two metals to be joined in intimate contact, and thereafter heating the metals to a temperature which will cause diffusion of the atoms of one or both metal parts into the other. When the workpiece is composed of two parts of the same metal, the joint will be substantially undetectable. In the case of different metals the joint will generally be an alloy of the metals with a composition graduating from one to the other.

Referring again to FIG. 3, we now discuss a typical HIP process. The shroud 22 is preferably a deformable metal container which is collapsible under pressures which produce diffusion bonding. The volume of the deformable container is such that the cladding-substrate assembly may be completely immersed in a granular, densifying pressure transmitting medium with sufficient clearances about the assembly edges such that during the diffusion bonding process none of the assembly edges will pierce the container when collapsed. Glass beads or chips are preferred as the pressure transmitting medium because the glass will densify and become molten at diffusion bonding temperatures to provide an optimum isostatic pressure transmitting medium. Moreover, glass is relatively inert, easily outgassed and can be easily removed from the surface of the assembly after the diffusion bonding step.

After the container is filled with both the cladding-substrate assembly and the pressure transmitting medium, the container is outgassed and sealed. Outgassing requires that the chamber within the container be connected to a suitable vacuum pump for removal of gaseous reaction products produced therein during heating. This is accomplished by hot evacuation of the entire assembly followed by a forge-weld seal-off from the vacuum system. If outgassing is not provided for, the resulting bond may be characterized by the presence of detrimental oxides and other impurities which may adversely affect the quality of the diffusive bond.

The sealed container is placed into a hot gas autoclave (hot isostatic press) for diffusion bonding at appropriate temperatures and pressures. It is sometimes desirable to avoid high pressures (7 KSI) before the pressure transmitting medium has softened. The application of high pressure before the glass chips have softened can, in some cases, cause a less-than-optimal surface finish.

After diffusion bonding of the cladding to the substrate, the assembly is removed from the deformable container and the glass which has adhered to the surfaces of the bonded cladded-substrate assembly is removed by sandblasting or by subsequent vacuum heating and water quenching of the assembly. Thereafter, the bonded cladding-substrate assembly may be subjected to a final heat treatment, if required.

In conventional HIP technology, the shroud 22 is made of molybdenum but other materials may be used. However, these materials are metals, and remnants of the material of the shroud which contacts the material to be sintered, may sometimes remain on the porous coating upon removal of the shroud. During the HIP sintering process, the heat and pressure employed may cause the molybdenum foil to diffusion bond to the underlying HIP sintering material (e.g. titanium beads or sheets). This would make complete removal of the molybdenum foil difficult, and could lead to presence of molybdenum foil remnants on the porous coating, which could be potentially undesirable in terms of biocompatibility. In one aspect of the present invention, hydroxyapatite (HA) powder is plasma sprayed onto the portions of the metal foil can material that will be placed in direct apposition to the porous coating during the HIP sintering process. The can is then applied to the substrate over the porous coated portion of the implant under vacuum by suitable means (e.g. welding, soldering) to evacuate air from the can. The porous coating is then subjected to the HIP process at a heat, pressure, and time sufficient to create a porous coating and/or bond the porous coating to the substrate without adversely affecting substrate microstructure. The implant is then cooled, and the can is then removed to expose the porous coating, wherein no material from the metal foil can remains attached to the porous coating after removal. Any HA coating remaining on the porous coating may be left on or removed by suitable means such as nitric acid dissolution. In addition to HA, other bioceramics may be used. Non-limiting examples include calcium phosphates or calcium sulfates, or other apatite compounds.

HA powder may alternatively be sprayed onto the porous coating prior to placement of the shroud to prevent metal-foil transfer during HIP processing and subsequent can removal. In addition to HA, other biocompatible calcium phosphates (e.g. tricalcium phosphate, bioglass) may be used. Titanium (Ti) foil could be used as an inner layer. Since titanium is known to be biocompatible, any well-bonded remnants could be left on the underlying titanium porous coating. Alternatively, the titanium foil layer could be removed by suitable means such as grit-blasting or acid etching. Porous coating materials can include titanium, zirconium, cobalt-chrome alloy, and tantalum. Implant substrate materials can include titanium alloy, zirconium alloy, cobalt-chrome alloy, or tantalum. The inner layer of the can (if used) could be composed of titanium, zirconium, cobalt-chrome alloy, or tantalum. The can could be composed of titanium, zirconium, cobalt-chrome alloy, or tantalum.

This aspect of the present invention allows for low-temperature sintering of porous coatings on implants without leaving remnants of molybdenum foil on the resulting porous coating. This invention is useful for attaching porous coatings (such as porous titanium coatings) to materials in which alteration of the substrate microstructure is undesirable.

The HIP process provides an ideal mechanism for minimizing or eliminating porosity or voids which occur during other types of metal joining processes. The simultaneous application of heat and isostatic pressure acts to collapse voids by creep-like mechanisms or compressive plastic deformation and thereby joins the materials by diffusion bonding. The net result is improved reliability and efficiency of materials utilized. Because of the tendency for most metals to acquire surface films of oxides and other compounds particularly when heated, the metal surfaces are preferably cleaned and heating is preferably done in an inert gas or substantially inert gas, or in a vacuum to prevent further oxidation.

The assembly is inserted into a deformable metal container which is collapsible under pressures which produce diffusion bonding. The volume of the deformable container is such that the cladding-substrate assembly may be completely immersed in a granular, densifying pressure transmitting medium with sufficient clearances about the assembly edges such that during the diffusion bonding process none of the assembly edges will pierce the container when collapsed. Glass beads or chips are preferred as the pressure transmitting medium because the glass will densify and become molten at diffusion bonding temperatures to provide an optimum isostatic pressure transmitting medium. Moreover, glass is relatively inert, easily outgassed and can be easily removed from the surface of the assembly after the diffusion bonding step.

Hot isostatic processes are generally conducted at elevated temperature, elevated pressure, and an inert atmosphere. Although the hot isostatic process is generally considered to be essentially oxygen free, the inventors have found that the inclusion of low levels of oxygen at the elevated pressures results in sufficient residual oxygen present to oxidize the bearing surfaces 12, 14, and 16 which results in an oxidation layer 30.

Inert gas, typically Argon (Ar) gas, is used in typical HIP processes. When inert gases such as argon are used, pressures ranging from about 2-3 atmospheres to about 30-50 atmospheres are used. The simultaneous HIP sintering of the bone-facing surfaces and the oxidation of the bearing surfaces of the implant can be accomplished in inert gas atmospheres provided high enough pressures are used. For instance, a typical grade of argon used for HIP sintering is of such a purity that it contains about 0.0005% oxygen. In a typical oxidation of a zirconium-based metal or metal alloy to blue-black oxidized zirconium, the oxidation is performed in an air atmosphere at ambient pressure (roughly 1 atmosphere). Assuming, to a first approximation, that air is 20% oxygen, this oxidative atmosphere has an oxygen partial pressure of 0.2 atm. Use of argon pressures that are much higher than those typically used in HIP processes (100 atm or greater as compared to a maximum of 50 atm), results in partial pressure of oxygen sufficient to form an acceptable blue-black oxide. If the HIP process uses 100 atm of argon having an oxygen content of 0.0005% is used, the partial pressure of oxygen is 0.05 atm. If the HIP process uses 1000 atm of argon having an oxygen content of 0.0005% is used, the partial pressure of oxygen is 0.5 atm. The table provided in FIG. 9 provides data of partial pressures of oxygen at different absolute pressures assuming a level of 0.0005% oxygen in the gas. However, the levels of oxygen in the HIP gas may vary as well. Oxygen levels of 0.05% to 0.00005% may be used. Higher total pressures of HIP gas will permit lower relative oxygen levels in the HIP gas, as such higher pressure serve to maintain a higher partial pressure of oxygen despite the lower overall relative oxygen levels. Longer HIP processing times may be necessary for lower levels of oxygen in order to form oxide layers of desirable thicknesses.

In some embodiments, one or more of surfaces 12, 14, and 16 are partially oxidized before attachment of the porous coating 20. The HIP process increases the thickness of the pre-existing, partially oxidized oxidation layer 30.

Figure 5:
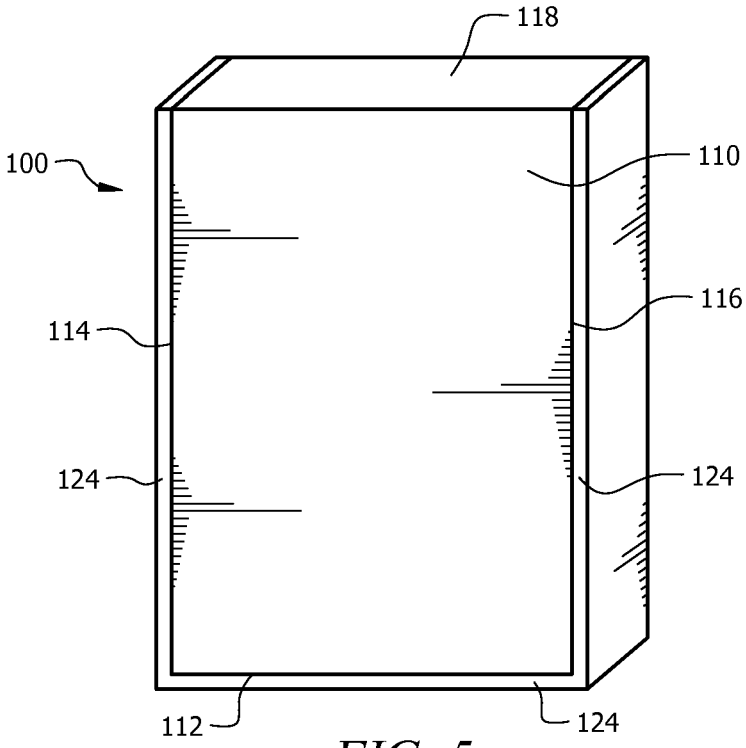
FIG. 5 is a front view of a medical implant having a diffusion hardened layer.

FIG. 5 illustrates a medical implant 100 having a first bearing surface 112, a second bearing surface 114, a third bearing surface 116, and a bone-facing surface 118. The medical implant 100 also includes a substrate 110 and a diffusion hardened layer 124.

Figure 6:
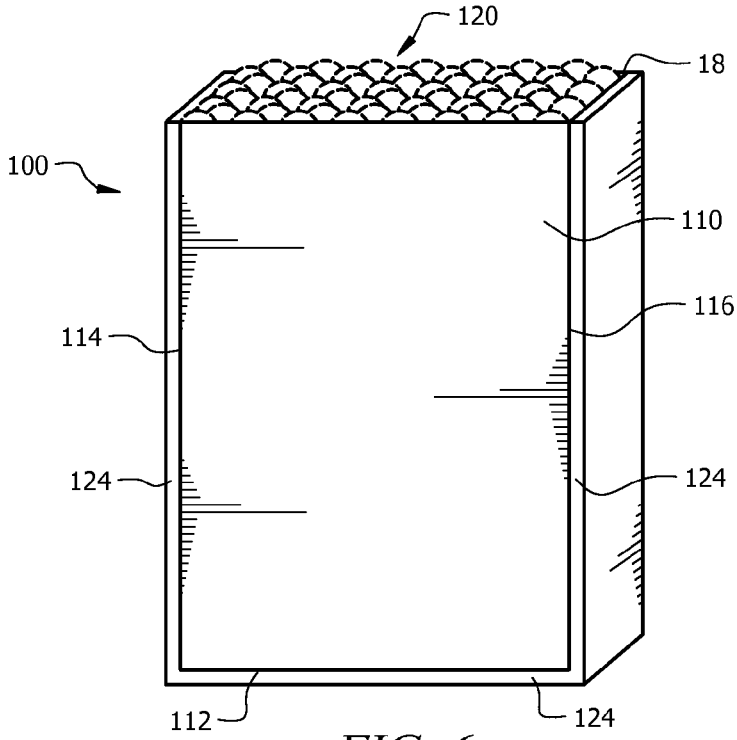
FIG. 6 is a front view of the medical implant with a porous metal coating.

FIG. 6 illustrates the medical implant 100 as in FIG. 5 having porous coating 120 applied to the bone facing surface 118. The porous coating 20 may take the form of beads or wire mesh. Zirconium or zirconium alloy can be used to provide the bead or wire mesh surface to which surrounding bone or other tissue may integrate to stabilize the prosthesis. These porous coatings can be treated simultaneously by the oxidation treatment in a manner similar to the oxidation of the base prosthesis for the elimination or reduction of metal ion release. Furthermore, zirconium or zirconium alloy can also be used as a surface layer applied over conventional implant materials prior to in situ oxidation and formation of the oxidized zirconium coating. Alternatively, the porous coating 120 may be made of titanium or titanium alloy, such as Ti-6Al-4V.

Figure 7:
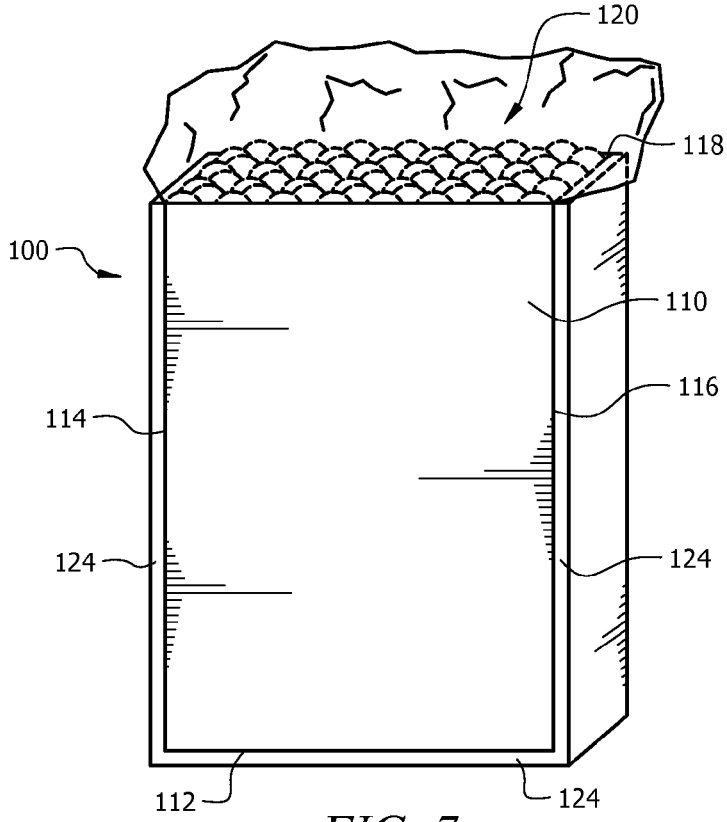
FIG. 7 is a front view of the medical implant with a shroud.

After the porous coating is applied to the substrate, it may be desirable to oxidize all or a portion of the implant. However, to prevent oxidization of the porous coating 120, the porous coating 120 may be covered with a protective coating or covering. FIG. 7 illustrates the medical implant 100 with shroud 122. In the embodiment depicted in FIG. 7, the shroud 122 is made of molybdenum but other materials may be used.

Figure 8A:
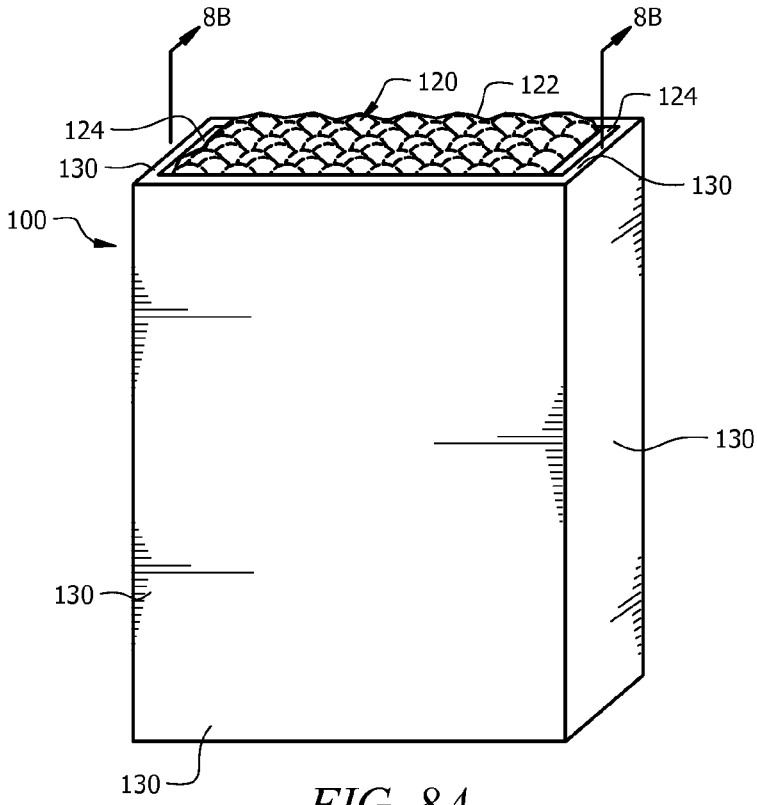
FIG. 8 is a front view of the medical implant with an oxidation layer on one or more surfaces.
FIG. 8B is a cross-sectional view of the medical implant of FIG. 8A.
Figure 8B:
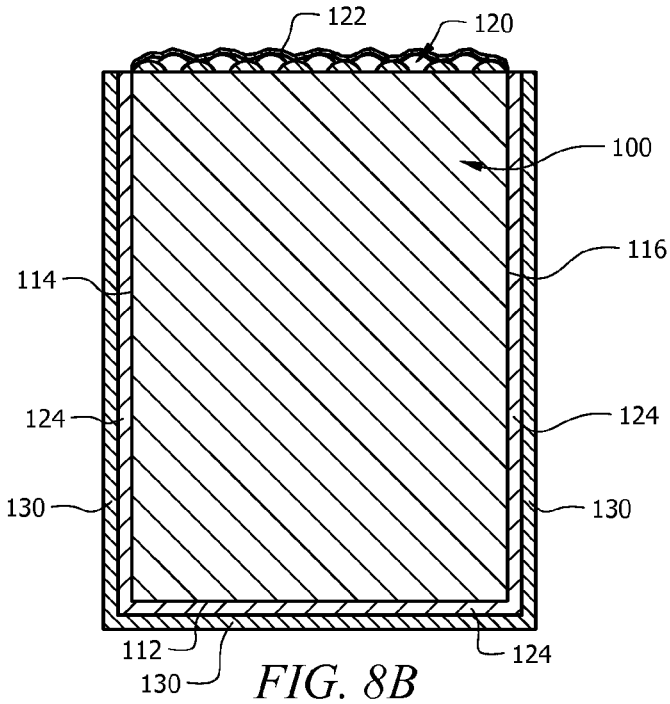

FIGS. 8A and 8B illustrate medical implant 100 after it been subjected to a hot isostatic press (HIP) to bond the porous coating 120 and, simultaneously, to at least partially oxidize the bearing surfaces 112, 114, 116. Although the hot isostatic process is generally considered to be essentially oxygen free, there is sufficient residual oxygen present to oxidize the bearing surfaces 112, 114, and 116 which results in an oxidation layer 130. In some embodiments, one or more of surfaces 112, 114, and 116 are partially oxidized before bonding of the porous coating 120. The HIP process increases the thickness of the pre-existing, partially oxidized oxidation layer 130. FIG. 8B is a cross-sectional view of the medical implant 100 of FIG. 8A. It should be noted that all surfaces not covered by shroud 122 and not otherwise shielded from the HIP process atmosphere will develop an oxide layer 130 to some extent.

Proper surface preparation helps to facilitate the formation of an acceptable blue-black oxidized zirconium in a simultaneous oxidation and HIP sintering of a zirconium or zirconium alloy work piece. An enhanced surface roughness increases surface area available to interact with the low levels of oxygen present in an inert gas-based HIP sintering process.

The medical implant 10, 100 may be any number of orthopaedic devices including, but not limited to, a hip prosthetic implant, a knee prosthetic implant, a spinal orthopaedic implant, and a shoulder orthopaedic implant. Those of ordinary skill in the art would understand that the present invention is applicable to any medical implant having at least one surface where a material is bonded to a substrate and at least one surface to be oxidized.

In some cases, it may be necessary to coat one or more surfaces 12, 14, 16, 112, 114, and 116 with a material containing oxygen, such as zirconium dioxide, prior to the HIP process. As the material is heated in the HIP process, the oxygen is released and used to oxidize portions of the medical implant 10, 100. Alternatively, the oxygen containing material may be placed on the shroud 22, 122 or in place of the shroud. Further, the oxygen containing material may simply be placed loosely within the pressure transmitting medium.

In some embodiments wherein the HIP process is performed in the presence of a binder material, the HIP sintering material and the binder are applied to the surface of the workpiece to be porous-coated. The purpose of the binder is to hold the HIP sintering material in place until sintering begins. A suitable binder is one that can be used in conjunction with the HIP sintering material and the implant substrate to sufficiently hold the HIP sintering material in place until the onset of sintering or until it can be restrained by other means (e.g. the foil can). Ideally, the binder also decomposes cleanly without substantially altering the chemistry of either the HIP sintering material or the implant substrate. The binder may be part of a binder system. This binder system may have more than one binder component and may include other components to improve the working properties (e.g. flow, viscosity, wettability, etc.) to make it easier to use in this application. Potentially suitable binders include, but are not limited to, methyl cellulose (MC), polyethylene glycol (PEG), polyvinyl alcohol (PVA), paraffin wax, naphthalene, or any combination thereof. The workpiece, HIP sintering material and binder are then enclosed in the HIP sintering enclosure, the enclosure having a vent to allow out-gassing. A vacuum heat treatment is performed to out-gas the binder. The method then proceeds as in the general embodiments, wherein the enclosure is substantially evacuated of all air. The vent is then sealed and the HIP process is performed. This technique is particularly useful in embodiments using particulate HIP sintering materials, as such materials are best used with a binder.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of making a medical implant having a porous surface and a blue, blue-black, or black oxidized zirconium, said method comprising:

forming a medical implant from a zirconium or zirconium alloy material;

applying a HIP sintering material to at least one surface of said implant;

attaching an enclosure around a surface of said implant such that the attached enclosure contains said HIP sintering material, said enclosure having an inner surface which is proximal to said implant surface and an outer surface which is distal to said implant surface and wherein the enclosure is formed of a collapsible material;

evacuating substantially all air from said enclosure;

sealing the evacuated enclosure;

placing said implant, said HIP sintering material, and said enclosure in a HIP furnace;

pressurizing the inside of said HIP furnace to an elevated pressure in an atmosphere comprising an inert gas and oxygen, said step of pressurizing comprising pressurizing to a total pressure of from about 20 to about 4000 bar and a partial pressure of oxygen of from about 0.1 to about 21 mbar;

adjusting the temperature in said furnace to a temperature of from 500° C. to 1000° C.; and, causing said implant, said HIP sintering material, and said enclosure in said HIP furnace to remain exposed to said temperatures and pressures for a time sufficient to fuse said HIP sintering material together and to said surface of said implant; and oxidize at least a portion of the surface of said implant to blue, blue-black, or black oxidized zirconium, said time ranging from about 30 minutes to about 10 hours; and thereafter, cooling said implant, said HIP sintering material, and said enclosure; and, removing said enclosure.

2. The method of claim 1, wherein said step of attaching an enclosure comprises attaching an enclosure having an inner surface comprising molybdenum.

3. The method of claim 1, wherein said step of attaching an enclosure comprises attaching an enclosure having an inner surface comprising hydroxyapatite.

4. The method of claim 1, wherein said inert gas comprises argon.

5. The method of claim 1, wherein said HIP sintering material is comprised of beads and/or particles of a US Sieve Series mesh size between 18 and 80.

6. The method of claim 1, wherein said step of adjusting the temperature in said furnace, comprises adjusting said temperature to a temperature below the temperature at which the material forming said implant, said HIP sintering material, or both said implant and HIP sintering material undergoes a change in microstructure.

7. The method of claim 1, wherein said HIP sintering material comprises zirconium or zirconium alloy.

8. The method of claim 7 wherein said zirconium alloy is Zr-2.5Nb.

9. The method of claim 1, wherein said HIP sintering material comprises titanium or titanium alloy.

10. The method of claim 9 wherein said titanium alloy is Ti-6Al-4V.

11. The method of claim 1, wherein said step of adjusting the temperature in said furnace, comprises adjusting said temperature to a temperature of 680° C.

12. The method of claim 1, wherein said step of pressurizing comprises pressurizing with a gas comprising oxygen at a level ranging from 0.05% to 0.00005%.

13. The method of claim 12, wherein said oxygen in said gas is at a level of 0.0005%.

14. The method of claim 1, wherein said time of exposure to fuse the HIP sintering material together and to the surface of the implant is about 4 hours.

15. The method of claim 1, further comprising the step of masking a portion of the surface of the zirconium or zirconium alloy medical implant prior to said step of placing said implant, said HIP sintering material, and said enclosure in a HIP furnace.

16. The method of claim 1, wherein said step of applying a HIP sintering material comprises applying a HIP sintering material and a binder to said at least one surface, said step of attaching an enclosure comprises attaching an enclosure comprising a vent, said method further comprising the step of vacuum treating said HIP sintering material, said binder, and said implant surface.

17. A method of making a medical implant having a blue, blue-black, or black oxidized zirconium, said method comprising:

forming a medical implant from a zirconium or zirconium alloy material;

placing said implant in a HIP furnace;

pressurizing the inside of said HIP furnace to an elevated pressure in an atmosphere comprising an inert gas and oxygen, said step of pressurizing comprising pressurizing to a total pressure of from about 20 to about 4000 bar and a partial pressure of oxygen of from about 0.1 to about 21 mbar;

adjusting the temperature in said furnace to a temperature of from 500° C. to 1000° C.; and, causing said implant to remain exposed to said temperatures and pressures for a time sufficient to oxidize at least a portion of the surface of said implant to blue, blue-black, or black oxidized zirconium, said time ranging from about 30 minutes to about 10 hours.

18. The method of claim 17, wherein said inert gas comprises argon.

19. The method of claim 17, wherein said step of adjusting the temperature in said furnace, comprises adjusting said temperature to a temperature below the temperature at which the material forming said implant undergoes a change in microstructure.

20. The method of claim 17 wherein said step of forming a medical implant from a zirconium or zirconium alloy material comprises forming said medical implant from Zr-2.5Nb alloy.

21. The method of claim 17, wherein said step of adjusting the temperature in said furnace, comprises adjusting said temperature to a temperature of 680° C.

22. The method of claim 17, wherein said step of pressurizing comprises pressurizing with a gas comprising oxygen at a level ranging from 0.05% to 0.00005%.

23. The method of claim 22, wherein said oxygen in said gas is at a level of 0.0005%.

24. The method of claim 17, wherein said time of exposure to fuse the HIP sintering material together and to the surface of the implant is about 4 hours.

25. The method of claim 17, further comprising the step of masking a portion of the surface of the zirconium or zirconium alloy medical implant prior to said step of placing said implant in a HIP furnace.

* * * * *